US007628275B2

(12) United States Patent
Smith

(10) Patent No.: US 7,628,275 B2
(45) Date of Patent: Dec. 8, 2009

(54) CRISIS RESPONSE KIT AND METHOD OF EMERGENCY PREPARATION

(76) Inventor: William J. Smith, 9 WoodRidge Cir., Canton, CT (US) 06019

( * ) Notice: Subject to any disclaimer, the term of this patent is extended or adjusted under 35 U.S.C. 154(b) by 468 days.

(21) Appl. No.: 11/271,421

(22) Filed: Nov. 9, 2005

(65) Prior Publication Data

US 2006/0108241 A1 May 25, 2006

Related U.S. Application Data

(60) Provisional application No. 60/626,156, filed on Nov. 9, 2004.

(51) Int. Cl.
*B65D 69/00* (2006.01)

(52) U.S. Cl. ..... 206/570; 206/232; 206/803

(58) Field of Classification Search ..... 206/216, 206/223, 232, 37, 38, 570, 803
See application file for complete search history.

(56) References Cited

U.S. PATENT DOCUMENTS

| | | | | | |
|---|---|---|---|---|---|
| 1,644,830 | A * | 10/1927 | Henderson | 206/803 |
| 5,011,020 | A * | 4/1991 | Stevens et al. | 206/570 |
| 5,515,974 | A * | 5/1996 | Higson | 206/570 |
| 5,884,760 | A * | 3/1999 | Carpenter | 206/223 |
| 6,116,426 | A * | 9/2000 | Slonim | 206/570 |
| 6,454,097 | B1 * | 9/2002 | Blanco | 206/570 |
| 6,957,738 | B2 * | 10/2005 | Hammond | 206/570 |
| 2004/0195134 | A1 * | 10/2004 | Li | 206/457 |
| 2004/0262190 | A1 * | 12/2004 | Bud | 206/570 |
| 2005/0121121 | A1 * | 6/2005 | Wang | 190/110 |

* cited by examiner

*Primary Examiner*—Luan K Bui
(74) *Attorney, Agent, or Firm*—Michard-Duffy Group LLP

(57) ABSTRACT

A method of preparing for emergencies in a building setting such as a school and using the method to create to a comprehensive crisis resource kit including evacuation plan, contact numbers, master contingency plan, flashlight, cell phone and first aid kit for use in a variety of emergency situations.

17 Claims, 4 Drawing Sheets

CRISIS RESPONSE KIT AND METHOD OF EMERGENCY PREPARATION

CROSS-REFERENCE TO RELATED APPLICATION

This application claims priority from provisional application Ser. No. 60/626,156, filed Nov. 9, 2004, the disclosure of which is incorporated by reference in its entirety.

FIELD OF THE INVENTION

The present invention relates generally to a method of preparing for emergencies in a building setting and to a comprehensive crisis resource kit designed for use in emergency situations. More particularly, to using the method of preparing for emergencies and the customized kit in such settings as schools where the kit is prepositioned around the building or complex, containing listings of people and procedures as well as emergency responder contact information, critical materials and communication devices for use in a variety of emergency situations.

BACKGROUND OF THE INVENTION

In the event of emergency situations, ad hoc response to the emergency can be dangerous to the health and well being of the people involved and may result in inadequate resources being brought to bear on the crisis. On the other extreme, ad hoc response can also result in over-reaction with unnecessary response by a variety of emergency responders whose time and resources are limited and must be used appropriately. Ready access to correct emergency responder contact numbers is critical to a proper response to emergency situations.

Examples of natural disaster emergency situations include fire, flood, power loss, snow storms, hurricanes or tornados. In today's uncertain geopolitical circumstances, threats such as bomb threats, hostage or firearm scares all can occur in private or public places. Businesses, schools and colleges, institutions, hospitals, day and elder care facilities are all settings where a conscientiously designed and applied emergency plan should be in place for each building in the facility. In many situations, the extent of prior planning is limited to requirements mandated by local fire codes. These are simple postings of building evacuation route schematics and emergency exit markings designed only for fire evacuation safety. A once per year fire alarm drill may be the only emergency practice anyone in the building experiences.

What is needed is a comprehensive plan for a variety of emergency or crisis situations. The positioning of the emergency planning booklets in easily accessible areas of each building is rarely considered. Such prepositioning of the plans along with critical devices for safety and communications during the crisis is a long needed but substantially unmet need in most building settings. It is an object of this invention to provide a method for implementing an emergency response plan. It is a further object to provide a crisis response kit containing all necessary components that satisfies the long-standing need for adequate preplanning along with ease of execution of the plans during the actual crisis. It is a further object to provide a summarized form of the full emergency plan in the form of an easily accessible flip chart for quick reference by building personnel.

SUMMARY OF THE INVENTION

The present invention resides in one aspect in a method of preparing for serious emergencies in a building which could be a single building or a complex of buildings such as a school, day care, elder care, commercial, governmental or industrial complex. The method includes a series of preparatory steps. The first step is compiling listings of all occupants of the building(s), known medical conditions of the occupants, a listing of emergency contacts such as police, fire, rescue, ambulance, medical, hazardous materials response teams, state and federal department of environmental protection, local state and federal emergency management agencies.

The next step involves creating a customized building evacuation plan which may include aerial views of the building, diagrams of the building, fire exits, routes to fire exits, assembly locations, locations of fire extinguishers, location and procedure for utility shutoffs, personnel trained in utility shutoffs and startups, and location of nearest helicopter landing areas for evacuation or landing of emergency responder personnel.

Another step in developing a crisis management plan for the building which ideally includes emergency procedures, evacuation plans and customized checklists for many types of emergencies with procedures and cross references to emergency response groups to be contacted in each type of emergency.

Another step in the method is creating a personnel management compilation which preferably includes listings of staff and building occupants, addresses and contact details for all staff and occupants, listings of known medical conditions of building occupants, availability and location of medications, food stores locations, water supply locations, photographs of staff and occupants, and listings of emergency response agencies with contact information.

Creation of a crisis response kit is also part of the method of the present invention which is accomplished by placing in a special container the written materials created in the foregoing steps of the method, namely putting into the container the crisis management plan, personnel management compilation, and building evacuation plan. Then the crisis response kit is stocked with additional items which are most useful in a crisis or emergency. The following are most often added to the interior of the crisis response kit container including a first aid kit, a cell phone, a flashlight, a plurality of emergency stickers. One or more of the crisis response kits are then positioned in the building(s) in easily accessible and visible locations.

The crisis response kit is most useful when it prepositioned in one or more places around the building so it will be easily reached during a crisis. It is preferably all self-contained in a specially designed container adapted to securely hold all components oft the kit in the interior space of the container using a set of receiving apertures arranged in the interior space. In the specialized holding compartments, are the contents of the kit including a first aid kit, a cell phone and a flashlight. The series of prepared notebooks created using the previously described method of the invention are also positioned in the specially adapted container. It has been found that the most convenient arrangement of the binders or notebooks for the kit include the crisis management plan, the personnel management compilation, and the building evacuation plan, all of which are conveniently placed inside the crisis response kit. The kit can preferably also contain a series of emergency stickers printed on sheets having a first reflective surface and a second surface having adhesive material layer thereon. These can be of the type suitable for hanging on doorknobs to restrict or encourage entrance to the door. The exterior of the kit more preferably has a series of stickers on the exterior of the container or case indicating what is contained inside including a symbol for telephone, first aid, and a safety symbol.

Still another embodiment of the invention is a specialized flip chart including a series of pages bound together by a page attachment device with a key holder securely attached to the flip chart. The key holder is adapted to receive one or more room keys. The flip chart includes pages relating to evacuation plans, procedures for emergencies, lists of contact numbers for emergency agencies. In the context of a school environment, one of the flip charts is intended to be available to the teacher in charge of each classroom in the school with the room key for that room attached to the flip chart. It is designed to be portable and provides a quickly accessible overview of what is in the full kit with checklists for easy reference for each type of emergency. The printed pages of the flip chart are small enough to fit in pocket or pocketbook and contains a summary of the most important information from the binders of the crisis response kit including simplified protocols and procedures for the various types of emergencies along with lists of contact numbers for emergency agencies to be contacted in each type of emergency. The flip chart may preferably include such emergencies as fire, hurricane, tornado, severe weather evacuations, chemical or hazardous material spills, bomb threat, and shelter-in-place situations where building occupants must remain in the building. The flip chart also has sheets with administration and emergency responders contact names, emergency responder telephone numbers, Red Cross contacts, and community based resource contacts.

DETAILED DESCRIPTION OF THE PREFERRED EMBODIMENTS

The crisis response kit of this invention is specially designed for use during building emergencies, critical incidents, or for training and practice of situational response drills. It is usable by businesses, schools and colleges, institutions, hospitals, day and elder care facilities, police, fire and emergency responders. The kits are intended be placed throughout the facility in key locations as determined by security directors, managers, or site based safety and security committees.

Figure 1:
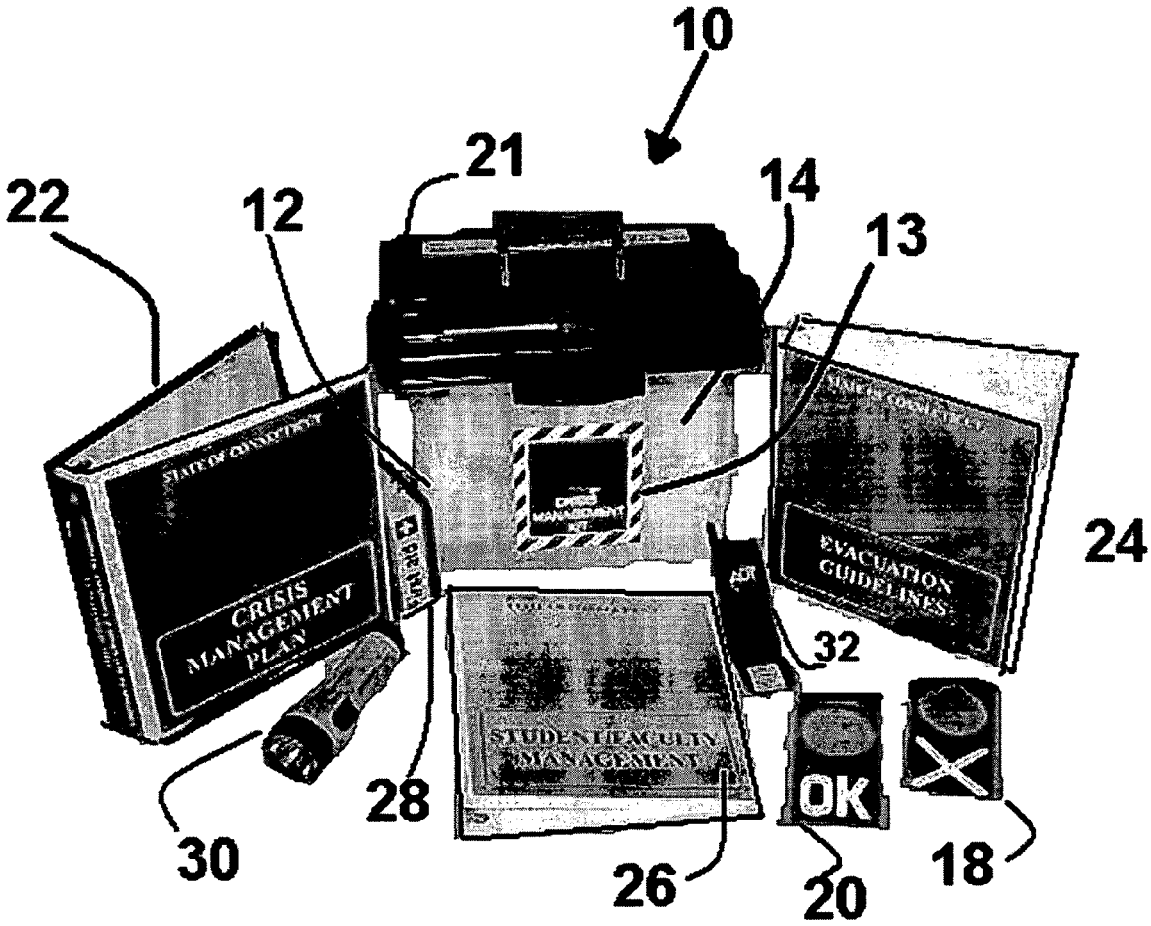
FIG. 1 is a perspective view of the crisis response kit of the invention with components displayed around the case.
Figure 2:
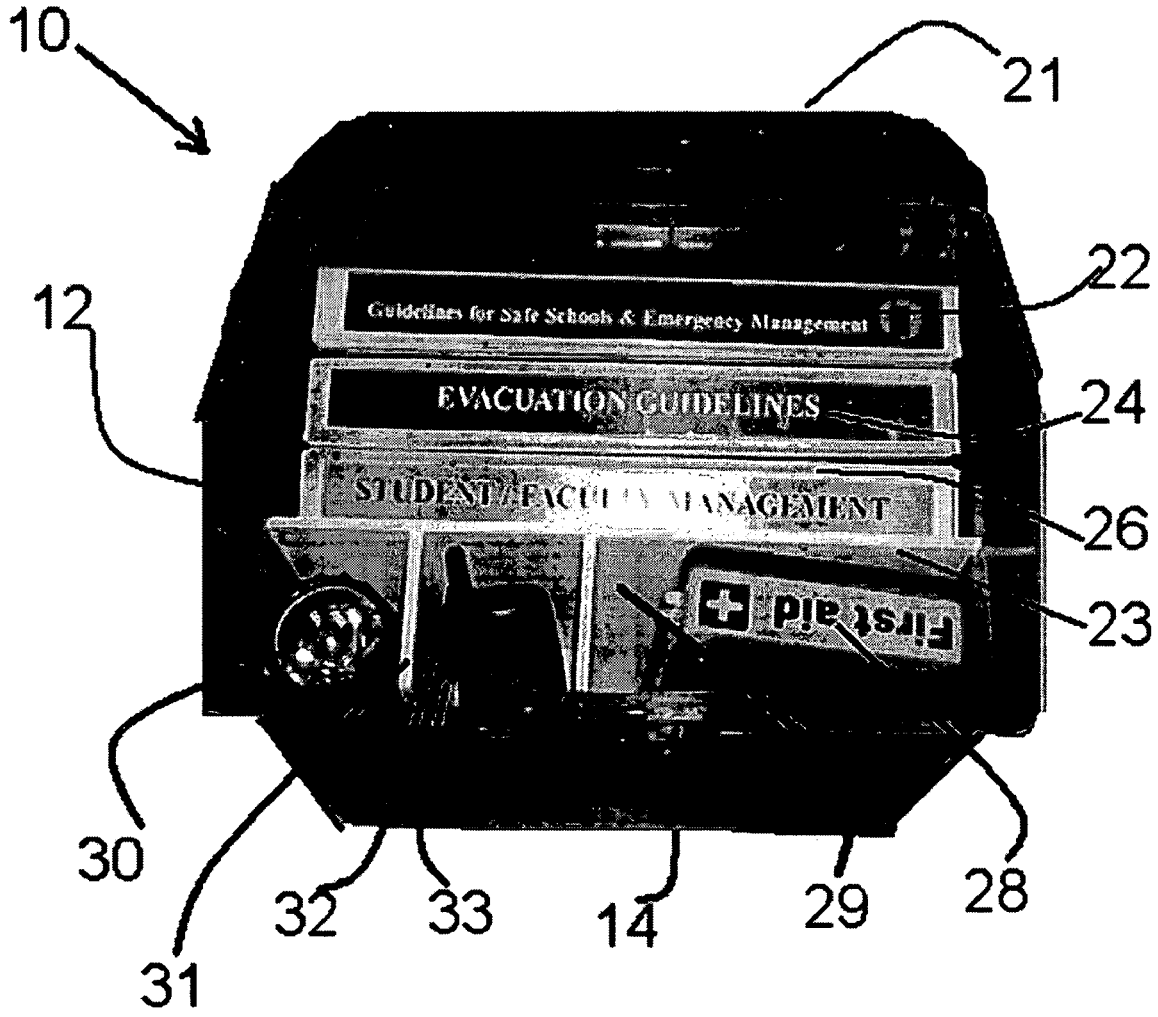
FIG. 2 is a plan view of a crisis response kit with the lid open.

FIG. 1 shows a rigid case embodiment of a crisis response kit 10 having exterior visible surfaces 12 that preferably have reflective decals 13 affixed on one or more of the exterior walls of the case 14 that holds all components of the kit. The case 14 shown in FIG. 1 is a molded plastic box. In the preferred embodiment shown in FIG. 1, the reflective decals are positioned as follows: Front facing—"Crisis Management Kit" 13; remainder of decals not shown, Left Side—"Telephone" symbol; Right Side—"First Aid symbol; Rear—"Safety First" Crisis Management Kit. Additionally, the kit preferably includes two highly reflective door knob placards 18 and 20, one colored Red with a White reflective "X", and another, colored Green with the letters "OK" in white reflective material. FIG. 2 shows the case in top plan view with the lid 21 opened. The Crisis Response kit 10 contains a molded plastic separation unit 23 to compartmentalize space required for binders labeled "Crisis Management Plan" 22, "Evacuation Guidelines" 24 and, "Student Facility Management"26. This binder is referred to elsewhere as Personnel Management compilation. It is understood that these binders 22, 24, 26 can carry any alternative titles as appropriate so long as they have contents sufficient to provide the critical information necessary in an emergency. Additionally, the contents of each of the indicated binders could be combined into one or more binders as the particular application dictates. The separation unit 23 is adjusted in dimension accordingly.

In addition important response and communication devises are also included in the kits 10 and 11. These include a first aid kit 28 which is held in the first aid aperture 29. The first aid kit should include barrier protection. A flashlight 30 with charge indicator is held in a flashlight aperture 31 formed by the separation unit 23, and a 911-capable, AAA battery adaptable cell phone 32, held in a cell phone aperture 33. Additional items can be added to the Crisis Response Kit to customize its application to the needs of the specific facility.

Figure 3:
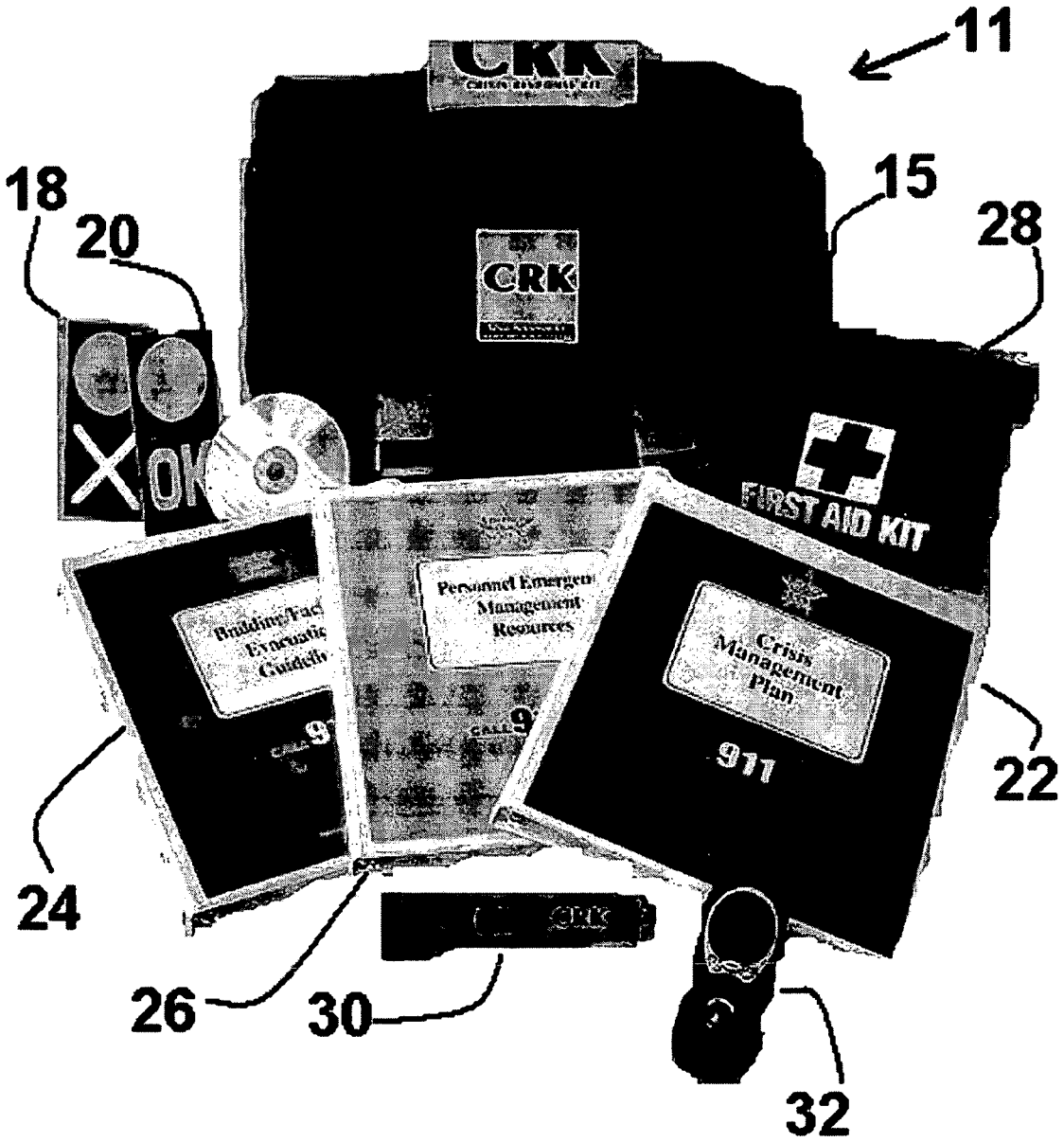
FIG. 3 is a perspective view of the crisis response kit with the components displayed around a flexible case.

FIG. 3 illustrates an embodiment of the crisis response kit 11 which utilizes a soft sided case 15 which has partitions built in comparable to the separation unit 23 but not shown which separates the components. This separation unit may be fabric partitions attached to the case 15. Other components are identical to the FIG. 1 embodiment and are identified with the same reference numbers.

Figure 4:
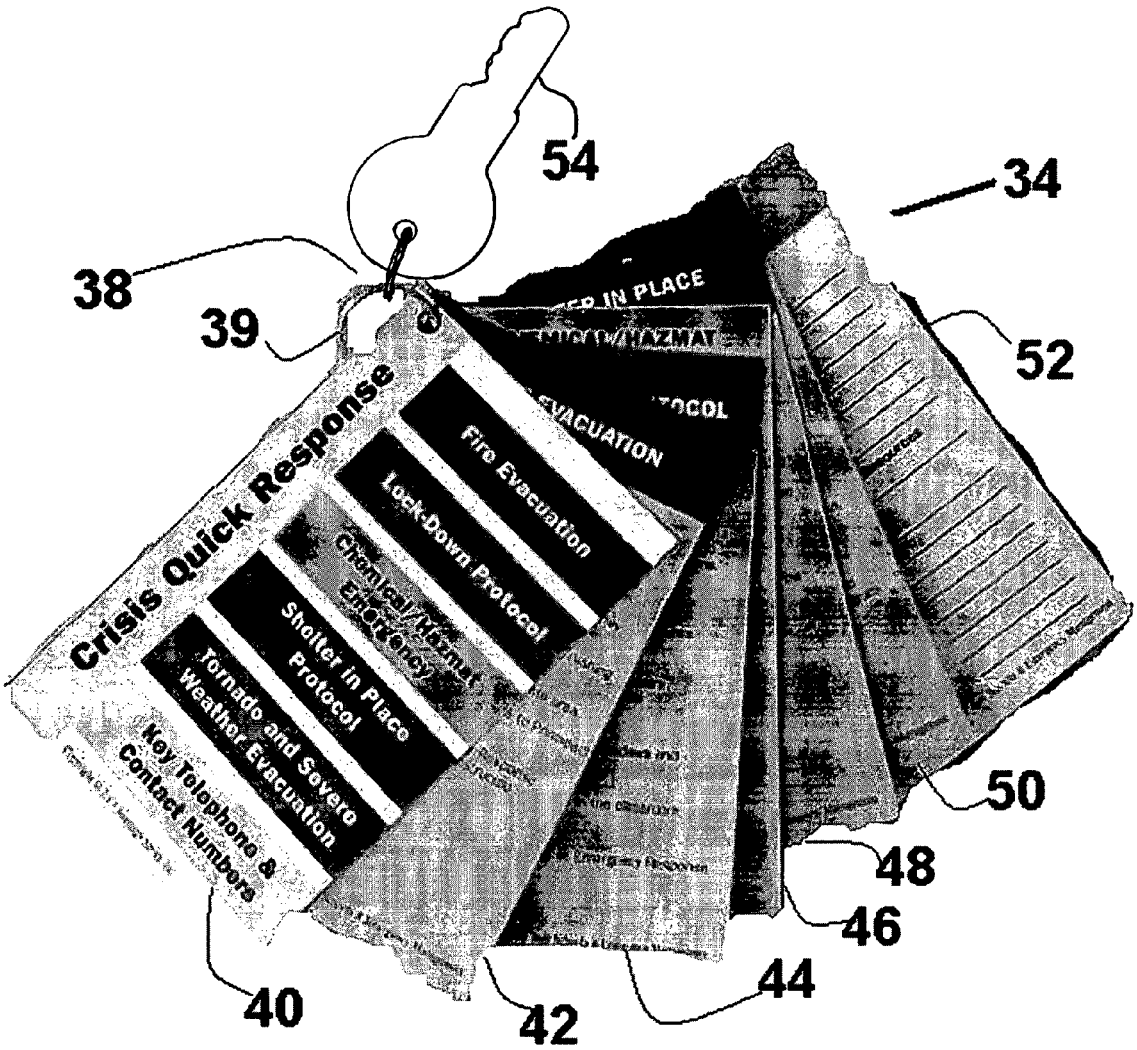
FIG. 4 is a perspective view of a summary flip chart with key holder attachment.

FIG. 4 shows a flip chart 34 designed to attach the building keys 36 to a convenient small summary chart of highlights of the plan. The flip chart has attached to it a ring key holder 38 which holds office, schoolroom or workplace room keys needed in an emergency to access particular areas. The flip chart is also provided with a page attachment device 39 which is this embodiment is the same ring structure to which the key is attached, and is adapted for keeping the pages together but allowing for periodic replacement of individual pages as updating of information is required. The compact color coded content summary sheet 40 of the emergency plans set forth on the pages of the flip chart allows rapid access to site-specific protocols and procedures that address particular emergencies such as fire 42, lock downs 44, chemical/hazmat emergencies 46, shelter-in-place protocols 48, hurricane, tornado and other severe weather emergencies 50. It also includes key contact names and telephone numbers for emergency responders and other community based resources 52. The key holder is adapted to receive one or more room keys 54. In the context of a school environment, one of the flip charts is intended to be available to the teacher in charge of each classroom in the school with the room key for that room attached to the flip chart. It is designed to be portable and provides a quickly accessible overview of what is in the full kit with checklists for easy reference for each type of emergency. The printed pages of the flip chart are small enough to fit in pocket or pocketbook and contains a summary of the most important information from the binders of the crisis response kit including simplified protocols and procedures for the various types of emergencies along with lists of contact numbers for emergency agencies to be contacted in each type of emergency.

The preparation and assembly of site specific portable crisis response kit and crisis quick response miniaturized flip chart are useful as a focus point for end users in preparing for possible emergency situations. Testing the kits through use of contained catalogued materials allows for specific customization and addresses the site based needs of each facility. Each site based safety and security team works with their constituents to assemble the kits and insure distribution throughout the organization. Kits should be inspected and updated at least once every six months to insure populated information is complete and correct.

The plurality of binders 22, 24, 26 in the kit contain important information. By way of example, the following recommendations for compiled listings and procedures for inclusion in the crisis response kit binders include:

(1) Crisis Management Plan
- (a) A complete, up to date, copy of the Crisis Management Plan
- (b) Tabulated checklists for handling common emergency events such as bomb threats, fires, lockdowns, weather related events, and other emergencies.

(2) Building(s) Evacuation Guidelines
- (a) Aerial Maps and Campus Diagrams of all buildings.
- (b) Multiple copies of simplified building and floor plans showing evacuation routes, assembly areas, designated receiving areas for building occupants, parents (in the case of schools or day care facilities), public information officer, and members of the press.
- (c) Site Maps and location of potential threat areas (Chemistry labs, shops, flammable storage areas).
- (d) Closest locations for a helicopter landing site.
- (e) Alternate site evacuation program.
- (f) Information about how to enable or disable electricity, gas, phone and other utilities at the school and a list of individuals who have been trained to do so.
- (g) Exact meeting points for identified staff members and emergency response personnel.

(3) Personnel Management Compilation
- (a) A list of people normally on site in the building. For example, in a school setting, the staff, students, teachers. For each person, names, addresses, and contact details, including known medical conditions of students and staff and the availability of medications during a lockdown or extended shelter-in-place event.
- (b) Food stores and potable water supply information.
- (c) School yearbook with photographs.
- (d) Attendance Sheet-Absentee listings.
- (e) Roster of teacher/staff and contact details including mobile phones.
- (f) list of local emergency response agencies contact numbers.
- (g) List of contact details for emergency response team, school crisis team, and school administration.

A duplicate copy of the crisis response kit should also be kept off-site; preferably at the home (district) office, state and/or local police, area fire department, town/ city/state/ federal offices of emergency management.

Although this invention has been shown and described with respect to the detailed embodiments thereof, it will be understood by those of skill in the art that various changes may be made and equivalents may be substituted for elements and steps thereof without departing from the scope of the invention. In addition, modifications may be made to adapt a particular situation to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. A crisis response kit comprising:

a case having a case bottom and opposing case sides which define an interior space, said case having a lid positioned moveably thereon between an open position and a closed position and wherein exterior surfaces of at least one of said case sides has contents indicia positioned thereon;

a separation unit in the interior space, the separation unit defining a plurality of receiving apertures in the interior space, the receiving apertures being adapted to receive a plurality of articles in said interior space, the separation unit comprising a plurality of panels including a first panel, a second panel and a third panel, each panel of the separation unit having edges and being disposed with at least one edge at the interior surface of the case, the first panel and the second panel each having an edge that joins to the third panel, the third panel traversing the case bottom and extending from one case side to an opposite case side;

a first aid kit set in a first aperture in said interior space;

a plurality of notebooks positioned in the interior space in a notebook receiving aperture, each of said notebooks having subject matter indicia positioned on an edge of said notebook such that said subject matter indicia is viewable when said lid is in said open position;

a cell phone positioned in a phone receiving aperture; and a flashlight positioned in a flashlight receiving aperture.

2. The crisis response kit according to claim 1 further comprising: a plurality of emergency stickers printed on sheets having a first reflective surface and a second surface having adhesive material layer thereon.

3. The crisis response kit according to claim 1 further comprising: a plurality of sheets having arranged thereon contact information for emergency agencies positioned in said interior space.

4. The crisis response kit according to claim 1 further comprising: a plurality of emergency procedures positioned in said interior space, wherein said plurality of emergency procedures includes maps of a facility and instructions for operation of utilities at the facility.

5. The crisis response kit according to claim 1 further comprising: a crisis management plan positioned in said interior space, wherein said crisis management plan includes a plurality of checklists for handling emergencies.

6. The crisis response kit according to claim 1 further comprising: a listing of staff and occupants of a selected building.

7. The crisis response kit according to claim 1 wherein the third panel is disposed in substantially perpendicular relation to the opposing case sides.

8. The crisis response kit according to claim 1 wherein the third panel has two sides and wherein the case has a receiving aperture on each side of the third panel.

9. The crisis response kit of claim 1, wherein said contents indicia comprises a telephone symbol.

10. The crisis response kit of claim 1, wherein said contents indicia comprises a first aid symbol.

11. The crisis response kit of claim 1, wherein said contents indicia comprises a crisis response symbol.

12. The crisis response kit of claim 1, wherein said subject matter indicia comprises a crisis management plan symbol.

13. The crisis response kit of claim 1, wherein said subject matter indicia comprises an evacuation guideline symbol.

14. The crisis response kit of claim 1, wherein said subject matter indicia comprises a student facility management symbol.

15. The crisis response kit of claim 8, wherein said plurality of notebooks is positioned substantially parallel to the third panel.

16. A crisis response system comprising:

a plurality of crisis response kits each being positioned at a predetermined location within a facility;

said plurality of crisis response kits each comprising a case having a case bottom and opposing case sides which define an interior space, said case having a lid positioned moveably thereon between an open position and a closed position and wherein exterior surfaces of at least one of said case sides has contents indicia positioned thereon;

a separation unit in the interior space, the separation unit defining a plurality of receiving apertures in the interior space, the receiving apertures being adapted to receive a plurality of articles in said interior space, the separation unit comprising a plurality of panels including a first panel, a second panel and a third panel, each panel of the separation unit having edges and being disposed with at least one edge at the interior surface of the case, the first panel and the second panel each having an edge that joins to the third panel, the third panel traversing the case bottom and extending from one case side to an opposite case side;

a first aid kit set in a first aperture in said interior space;

a plurality of notebooks positioned in the interior space in a notebook receiving aperture, each of said notebooks having subject matter indicia positioned on an edge of said notebook such that said subject matter indicia is viewable when said lid is in said open position;

a cell phone positioned in a phone receiving aperture; and a flashlight positioned in a flashlight receiving aperture.

17. The crisis response system of claim 16 wherein at least one of said plurality of crisis response kits is positioned at a location remote from said facility.

* * * * *